US007995086B2

(12) United States Patent
Nakahara

(10) Patent No.: US 7,995,086 B2
(45) Date of Patent: Aug. 9, 2011

(54) IMAGE FORMING APPARATUS, IMAGE FORMING METHOD AND IMAGE PROCESSING APPARATUS

(75) Inventor: Nobuhiko Nakahara, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 111 days.

(21) Appl. No.: 12/579,708

(22) Filed: Oct. 15, 2009

(65) Prior Publication Data

US 2010/0098444 A1 Apr. 22, 2010

Related U.S. Application Data

(60) Provisional application No. 61/107,508, filed on Oct. 22, 2008.

(51) Int. Cl.
*B41J 2/47* (2006.01)

(52) U.S. Cl. ..... 347/239; 347/255

(58) Field of Classification Search ..... 347/233, 347/234, 239, 248, 252–255
See application file for complete search history.

(56) References Cited

U.S. PATENT DOCUMENTS 6,873,350 B2 * 3/2005 Saito et al. ..... 347/239
7,030,899 B2 * 4/2006 Hoshino et al. ..... 347/236

FOREIGN PATENT DOCUMENTS

JP 2004-077714 3/2004
JP 2008-012806 1/2008

* cited by examiner

*Primary Examiner* — Hai C Pham
(74) *Attorney, Agent, or Firm* — Turocy & Watson, LLP

(57) ABSTRACT

An image forming apparatus includes a laser array in which n light emitting sources are arrayed, an image-input converting unit configured to create, for each of channels of the laser array, a recording pattern for executing PWC from input image data and extract recording patterns of an nth channel and a first channel of the next scanning of the laser array, an overlapping control unit configured to calculate the width of laser pulses in the same position in a main scanning direction as overlapping width, a data correcting unit configured to reduce laser pulse width by a reduction amount corresponding to the calculated overlapping width and correct the laser pulse width, and a laser driver configured to control the intensity of laser beams in the respective channels of the laser array according to the recording patterns after the correction.

20 Claims, 8 Drawing Sheets

| Overlapping ratio (%) | Reduction ratio (%) |
|---|---|
| 50 | 16 |
| 100 | 13 |
| 150 | 5 |
| 200 | 4 |
| 250 | 4 |
| 300 | 4 |
| 350 | 3 |
| 400 | 3 |
| 800 | 3 |

IMAGE FORMING APPARATUS, IMAGE FORMING METHOD AND IMAGE PROCESSING APPARATUS

CROSS REFERENCE TO RELATED APPLICATION

This application is based upon and claims the benefit of U.S. Provisional Application No. 61/107,508, filed on Oct. 22, 2008.

TECHNICAL FIELD

Described herein relates to a technique for correcting density unevenness due to a reciprocity failure of an electrophotographic recording apparatus such as a MFP in which a multi-channel laser array is used as a light source.

BACKGROUND

In the past, there are an electrophotographic MFP, a laser printer, and the like that record and form an image using a single laser element that irradiates one laser beam or using a plurality of the laser elements. However, recently, the electrophotographic MFP and the laser printer are mounted with a laser array instead of the laser element. In the laser array, plural laser elements are arranged at equal intervals. The electrophotographic MFP and the laser printer employing the laser array can record plural lines of an image in one scan.

In the past, in general, the resolution of an image forming apparatus is equal to or lower than 600 dpi. However, according to the technical improvement in recent years, image forming apparatuses having high resolution such as 1200 dpi and 2400 dpi are also put to practical use.

According to the progress of the increase in resolution, a new problem becomes obvious. Specifically, because of the progress of the increase in resolution, when an electrostatic latent image is formed, spots of beams irradiated on a photoconductive member overlap one another. If timing of one overlapping spot is different from timing of another, irregularity occurs in potential after exposure of the photoconductive member. This leads to image density unevenness.

This phenomenon is called reciprocity failure (JP-A-2004-20911). As techniques for reducing the influence of density unevenness due to the reciprocity failure, there are techniques explained below.

In a technique disclosed in JP-A-2004-77714, skip scanning is performed by using plural beams.

Therefore, time of scanning intervals for arbitrary scanning lines can be set to be equal to or larger than one main scanning time. As a result, an image quality defect due to the reciprocity failure is reduced.

In a technique disclosed in JP-A-2008-12806, it is determined whether overlapping writings are present in predetermined images adjacent to each other in a sub-scanning direction. Writing timing is changed according to presence or absence of the overlapping writings.

SUMMARY

Described herein relates to an image forming apparatus including: a laser array in which n (a natural number equal to or larger than 2) light emitting sources are arrayed; a polygon mirror configured to reflect n laser beams emitted from the laser array and periodically scan a rotating photoconductive member to form an image on the photoconductive member; an image-input converting unit configured to create, for each of channels of the laser array, a recording pattern for executing pulse width control from input image data and extract recording patterns of an nth channel and a first channel of the next scanning of the laser array; an overlapping control unit configured to calculate the width of laser pulses in the same position in a main scanning direction as overlapping width from the extracted two recording patterns; a data correcting unit configured to reduce laser pulse width in at least one recording pattern of the recording patterns of the nth channel and the first channel of the next scanning by a reduction amount corresponding to the calculated overlapping width and correct the laser pulse width; and a laser driver configured to control the intensity of laser beams in the respective channels of the laser array according to the recording patterns after the correction.

Described herein relates to an image forming method for an image forming apparatus that reflects, via a polygon mirror, n (a natural number equal to or larger than 2) laser beams emitted from a laser array in which n light emitting sources are arrayed and periodically scans a rotating photoconductive member to form an image, the method including: creating, with an image-input converting unit, for each of channels of the laser array, a recording pattern for executing pulse width control from input image data and extracting recording patterns of an nth channel and a first channel of the next scanning of the laser array;

calculating, with an overlapping control unit, the width of laser pulses in the same position in a main scanning direction as overlapping width from the extracted two recording patterns; reducing, with a data correcting unit, laser pulse width in at least one recording pattern of the recording patterns of the nth channel and the first channel of the next scanning by a reduction amount corresponding to the calculated overlapping width and correcting the laser pulse width; and controlling, with a laser driver, the intensity of laser beams in the respective channels of the laser array according to the recording patterns after the correction.

Described herein relates to an image processing apparatus that processes image data converted from a read document image and outputs the image data to an image forming apparatus that reflects, via a polygon mirror, n (a natural number equal to or larger than 2) laser beams emitted from a laser array in which n light emitting sources are arrayed and periodically scans a rotating photoconductive member to form an image, the image processing apparatus including: an image input unit configured to read a document image and convert the document image into image data; an image processing unit configured to subject the image data after the conversion to image processing; an image-input converting unit configured to create, for each of channels of the laser array, a recording pattern for executing pulse width control from the image data subjected to image processing and extract recording patterns of an nth channel and a first channel of the next scanning of the laser array; an overlapping control unit configured to calculate the width of laser pulses in the same position in a main scanning direction as overlapping width from the extracted two recording patterns; a data correcting unit configured to reduce laser pulse width in at least one recording pattern of the recording patterns of the nth channel and the first channel of the next scanning by a reduction amount corresponding to the calculated overlapping width and correct the laser pulse width; and a laser driver configured to control the intensity of laser beams in the respective channels of the laser array according to the recording patterns after the correction.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION

An image forming apparatus according to an embodiment of the present invention is explained below with reference to a digital multi function peripheral (MFP) employing an electrophotographic printer as an example.

Figure 1:
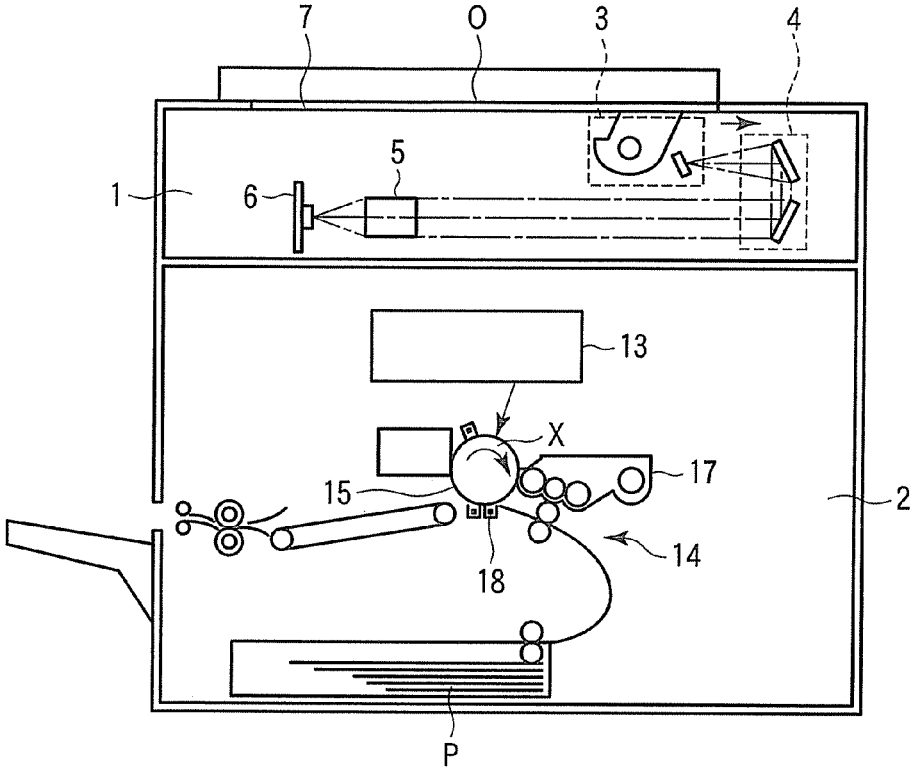
FIG. 1 is a schematic diagram of a configuration of a digital multi function peripheral.

FIG. 1 is a schematic diagram of a configuration of the digital multi function peripheral. The digital multi function peripheral includes, for example, a scanner unit 1 and a printer unit 2.

The scanner unit 1 includes a first carriage 3, a second carriage 4, a focusing lens 5, and a photoelectric conversion element 6. The first carriage 3 is movable in an arrow direction shown in the figure.

The scanner unit 1 sequentially reads an image of an original document O placed on a document table 7 line by line. An image processing unit converts reading output into, for example, an 8-bit digital image signal that indicates shading of the image.

The printer unit 2 includes an optical system unit 13 and an image forming unit 14. The image forming unit 14 is combined with an electrophotographic system that can form an image on a sheet P as an image formation medium.

The image processing unit processes an image signal read from the original document O by the scanner unit 1. A semiconductor laser oscillator in the optical system unit 13 irradiates a laser beam corresponding to the processed image signal.

The laser beam irradiated from the optical system unit 13 is focused, as spot scanning light, in an exposure position X on a photoconductive drum 15 as an image bearing member and is served for scanning exposure. An electrostatic latent image corresponding to the image signal is formed on the photoconductive drum 15.

The electrostatic latent image on the photoconductive drum 15 is changed to a toner image by a toner (a developer) supplied from a developing device 17. A transfer charger 18 transfers the toner image on the photoconductive drum 15 onto the sheet P fed to be timed to coincide with the transfer by a paper feeding system at a point of a transfer position.

Image forming operation is continuously performed by repeating the process operation explained above.

The optical system unit 13 is explained below.

Figure 2:
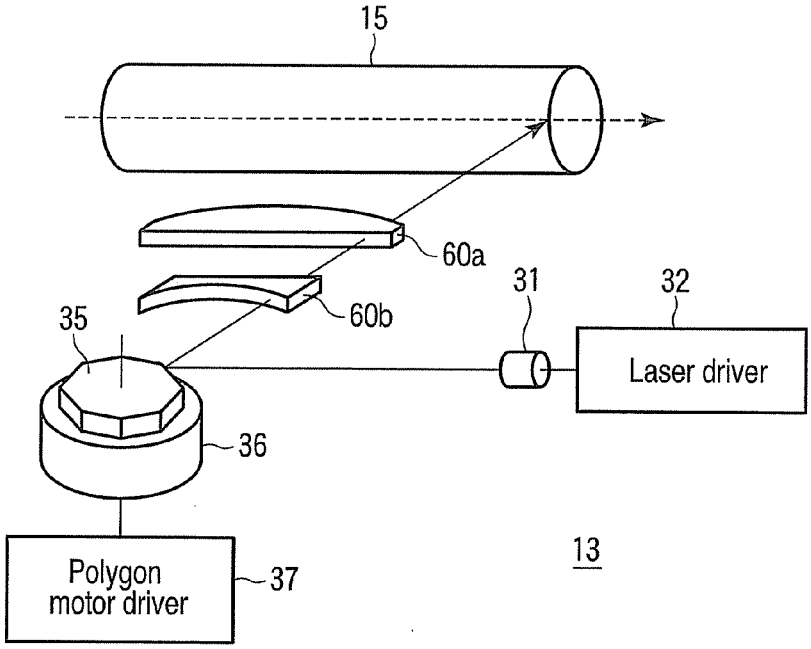
FIG. 2 is a diagram of a configuration of an optical system unit and a positional relation of a photoconductive drum.

FIG. 2 is a diagram of a configuration of the optical system unit 13 and a positional relation of the photoconductive drum 15. The optical system unit 13 incorporates a four-channel laser array (hereinafter referred to as laser) 31. The laser 31 performs image formation for every four scanning lines. A laser driver 32 drives the laser 31. A beam output from the laser 31 is made incident on a polygon mirror 35 as a polygonal rotating mirror after passing through a collimator lens.

A polygon motor driver 37 drives a polygon motor 36. The polygon motor 36 rotates the polygon mirror 35 at constant speed. Reflected light from the polygonal mirror 35 scans in a fixed direction at angular velocity decided by the number of revolutions of the polygon motor 36. The scanning beam scans the photoconductive drum 15 at constant speed by passing through lenses 60*a* and 60*b*.

A cause of occurrence of a reciprocity failure in the image forming operation by the optical system unit 13 is explained below.

Figure 3:
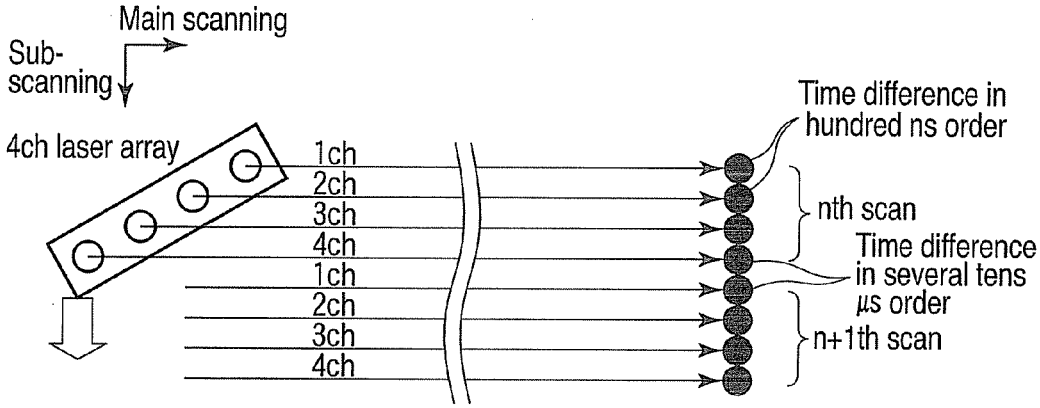
FIG. 3 is a diagram of an example of scanning by a four-channel laser array.

FIG. 3 is a diagram of an example of scanning by a four-channel laser array.

A lateral direction in the figure represents a main scanning direction and a longitudinal direction in the figure represents a sub-scanning direction. The laser array has a very small tilt with respect to the sub-scanning direction. Therefore, laser beams of the respective channels reflected on the same surface of the polygon mirror 35 scan the photoconductive drum 15 with a time difference in hundred nanosecond (ns) order.

However, the next scanning timing is after elapse of time for the polygon mirror 35 to rotate by an angle equivalent to one surface. Therefore, in FIG. 3, a time difference in several tens microsecond (μs) order occurs from laser irradiation in a fourth channel in an nth scan until laser irradiation in a first channel in an n+1th scan.

Figure 4:
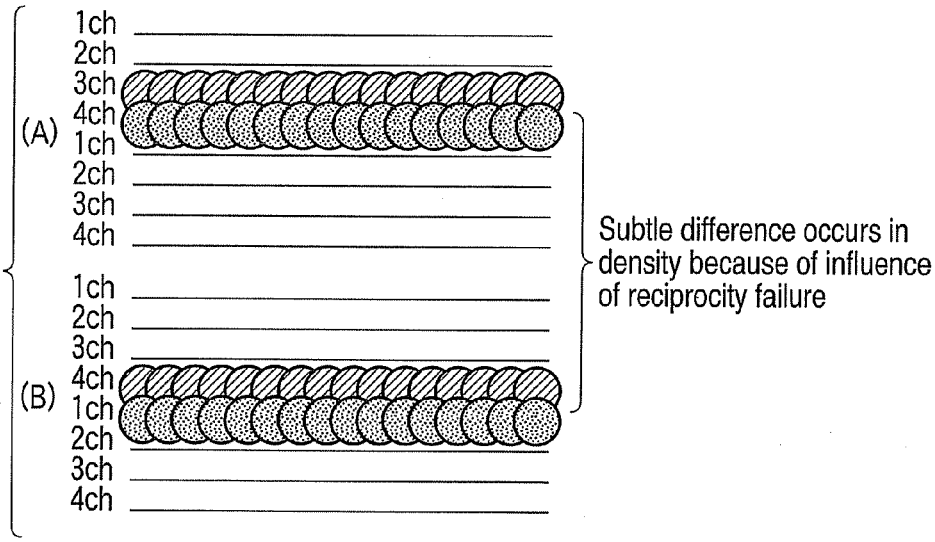
FIG. 4 is a diagram of states in which a reciprocity failure occurs.

FIGS. 4A and 4B are diagrams of states in which a reciprocity failure occurs. In an example shown in FIGS. 4A and 4B, two beams continuing in the sub-scanning direction are turned on and six beams continuing in the sub-scanning direction are turned off by using the four-channel laser array when resolution is set to 1200 dpi.

In FIG. 4A, beams from a third channel (CH) and a fourth channel (CH) substantially simultaneously expose the photoconductive drum 15. A distance between the channels is about 21 microns when the resolution is 1200 dpi. A spot diameter of the lasers is larger than the distance. Therefore, in an overlapping area, a large amount of light is irradiated at substantially the same timings.

On the other hand, in FIG. 4B, after the beam from the fourth CH exposes the photoconductive drum 15 first, a beam from a first CH exposes the photoconductive drum 15 after elapse of time longer than time in the case of the exposure shown in FIG. 4A. Therefore, in the overlapping area, a large amount of light is irradiated at different timings separated in time.

As a result, potential falls in a section of the photoconductive drum 15 where a laser beam is irradiated again after some time. Therefore, the contrast of a latent image increases and image density increases. When the exposures shown in FIGS. 4A and 4B are performed in one screen, developed lines appear as density unevenness.

As explained above, a reciprocity failure occurs because a latent image forming state is different when a relation between an amount of light and exposure time is different even if gross exposure energy density given to a photoconductive member is the same.

There is an idea that, since density unevenness that occurs because of the reciprocity failure is a subtle difference and sections where the density unevenness occurs disperse at random in an image, the density unevenness hardly poses a visual problem during normal image formation. However, the density unevenness due to the reciprocity failure is visually recognized as an image quality failure depending on a screen generation condition explained later. Further, for example, in registration correction by digital data, the density unevenness is conspicuous and causes image quality deterioration.

In this embodiment, a method of applying correction of a reciprocity failure to an electrophotographic engine that forms a 1200 dpi image using the four-channel laser array is explained.

For the 2-on-6-off line image in the example explained above, digital data correction by data amount reduction of about several percent is effective. The digital data correction by the data amount reduction of about several percent was executed on a halftone image like a halftone dot in the same manner. However, a sufficient effect could not be displayed for the halftone image.

A difference in a configuration of pixels between the halftone image and the line image affects the effect of the correction.

Figure 5:
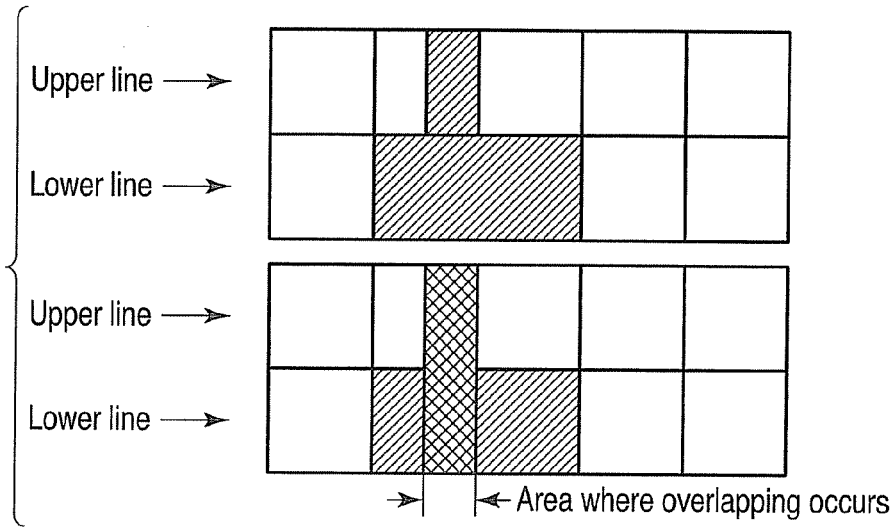
FIG. 5 is a schematic diagram of configurations of pixels in upper and lower two lines of a halftone image.
Figure 6:
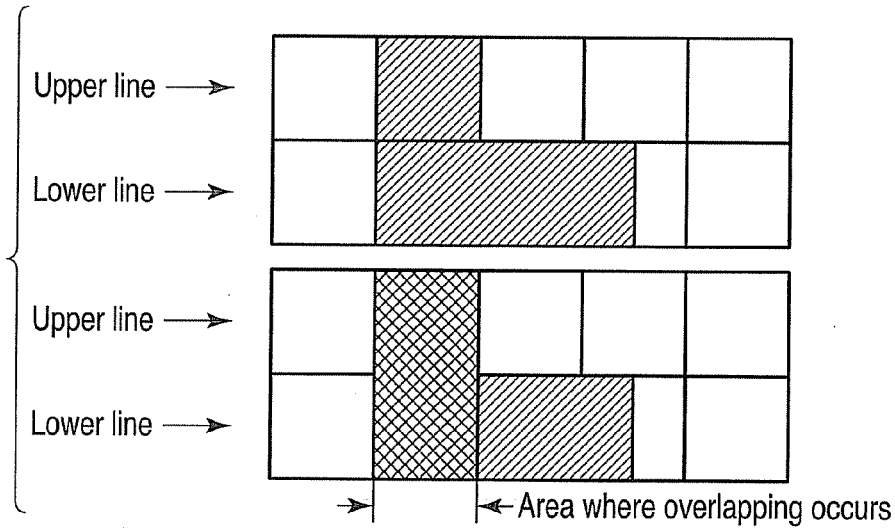
FIG. 6 is a schematic diagram of configurations of pixels of upper and lower two lines of a halftone image.

FIGS. 5 and 6 are schematic diagrams of a configuration of pixels in upper and lower two lines of the halftone image. As shown in the figures, in the halftone image, the configuration of the pixels is interrupted in a reference pixel unit. In the halftone image, half-pitch pixels are often used. On the other hand, the line image has a configuration of solid pixels in upper and lower two lines.

In halftone images in which configurations of upper and lower pixels are different, density unevennesses are also different because the configurations are different. Therefore, if all the halftone images are corrected under the same condition, the density unevennesses are insufficiently solved. It can be understood that more precise control corresponding to the configurations of the pixels is necessary.

According to the examination result explained above, in this embodiment, more precise control is executed with the inside and the outside of one pixel in the main scanning direction set as targets.

The density unevenness due to the reciprocity failure can be corrected by adjusting a reduction amount for holding down density according to the width of an area where upper and lower lines of a halftone pattern overlap.

For example, in FIG. 5, a half (50%) of one pixel as a pattern of the upper line overlaps a pattern of the lower line. In FIG. 6, one pixel (100%) as a pattern of the upper line overlaps a pattern of the lower line.

Therefore, various different correction amounts are used according to the width of the overlap of corresponding recording patterns in the main scanning direction between plural pixels adjacent to each other in the sub-scanning direction.

Figures 7, 8:
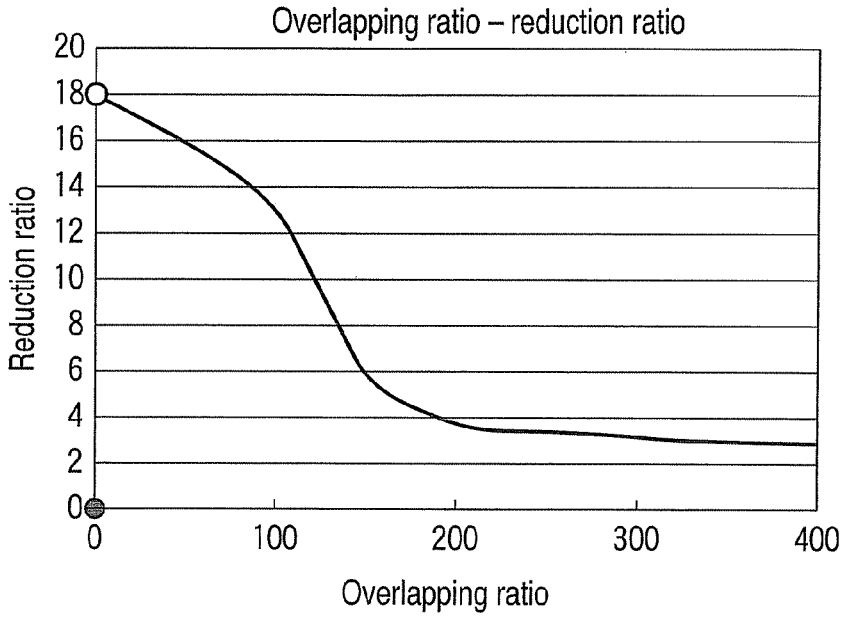
FIG. 7 is a characteristic curve chart representing a relation between an upper-and-lower-lines continuous overlapping ratio and a reduction ratio.
FIG. 8 is a table of specific values of an upper-and-lower-lines overlapping ratio and a reduction ratio calculated by a test.

FIG. 7 is a characteristic curve chart representing a relation between an upper-and-lower-lines continuous overlapping ratio and a reduction ratio.

The upper-and-lower-lines continuous overlapping ratio is a value obtained by representing, with the width of one pixel set as 100%, the width of an area where upper and lower lines of a halftone pattern overlap. The reduction ratio is a value obtained by representing a reduction amount of data with an amount of one pixel set as 100%.

When the width of an overlapping section is small, the reduction ratio is large because the influence of the reciprocity failure is relatively large. As the width of the overlapping section increases, the reduction ratio decreases because the relative influence of the reciprocity failure gradually decreases. The reduction ratio saturates at a point when the width of the overlapping is large to a certain degree.

It is seen that the characteristic shown in FIG. 7 can be applied not only to the halftone image but also to a solid image.

The characteristic curve shown in FIG. 7 is obtained by repeatedly performing tests to calculate, concerning each of plural upper-and-lower-lines overlapping ratios, a reduction ratio that is effective for correction of the reciprocity failure when the resolution is 1200 dpi. Specific values of the upper-and-lower-lines overlapping ratio and the reduction ratio calculated in the tests are shown in FIG. 8.

An example of reduction of a data amount is explained with reference to FIGS. 9 to 11.

With driving of a laser in actually forming an image, an image is formed on a photoconductive member by making use of a PWM (Pulse Width Modulation) technique. In one pixel, the pixels are grown from section on the left, or on the right, or in the center by making use of positioning control of PWM. A more stable pixel can be formed by adjusting a recording position relation with output patterns of peripheral pixels according to the positioning control of PWM.

Figure 9:
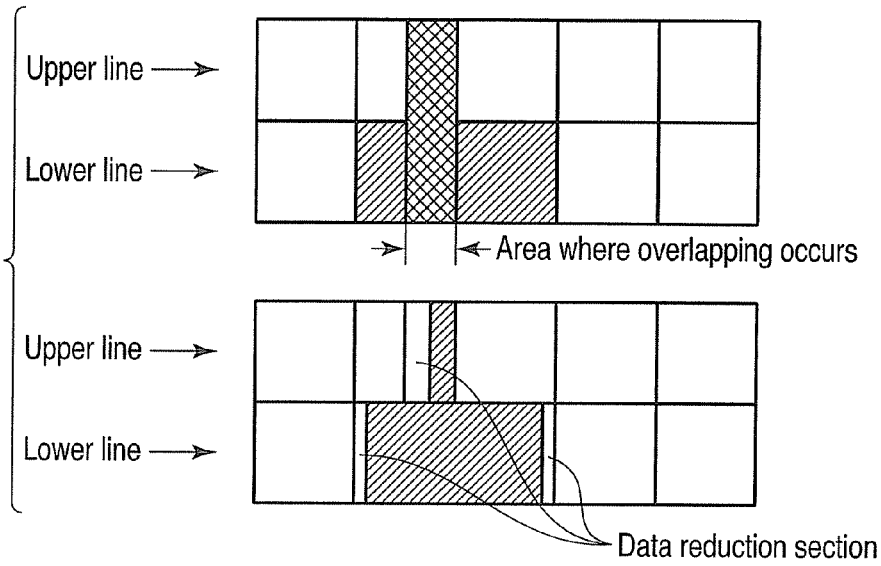
FIG. 9 is a diagram of an example of reduction of a data amount performed when the upper-and-lower-lines continuous overlapping ratio is 50%.

FIG. 9 is a diagram of an example of reduction of a data amount performed when the upper-and-lower-lines continuous overlapping ratio is 50%. The reduction rate is 13% when the upper-and-lower-lines continuous overlapping ratio is 50%. Therefore, a data amount equivalent to 13% is reduced in both the upper line and the lower line. In the upper line, in one pixel, since the pixel grows from the right to the left, the left side of data is reduced by 13%. In the lower line, in one pixel, the pixel grows from the right to the left. In other pixels, the pixels grow from the left to the right. Therefore, each of both the ends (left and right) of data is reduced by 6.5%.

Figure 10:
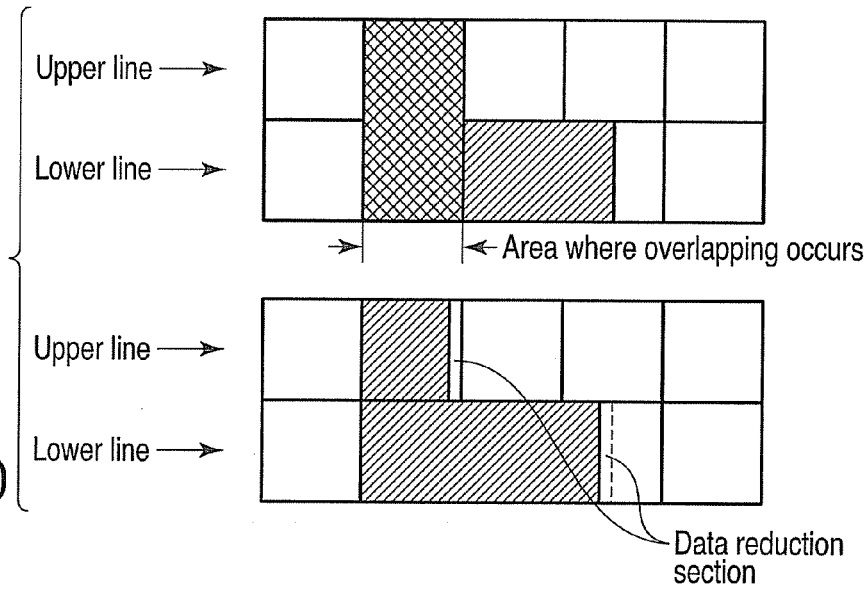
FIG. 10 is a diagram of an example of reduction of a data amount performed when the upper-and-lower-lines continuous overlapping ratio is 100%.

FIG. 10 is a diagram of an example of reduction of a data amount performed when the upper-and-lower-lines continuous overlapping ratio is 100%. The reduction ratio is 13% when the upper-and-lower-lines continuous overlapping ratio is 100%. Therefore, a data amount equivalent to 13% is reduced in both the upper line and the lower line. In the upper line, in one pixel, since the pixel grows from the left to the right, the right side of data is reduced by 13%. In the lower line, in packed two pixels, since the pixels grow from the left to the right, the right side of data is reduced by 13%.

Figure 11:
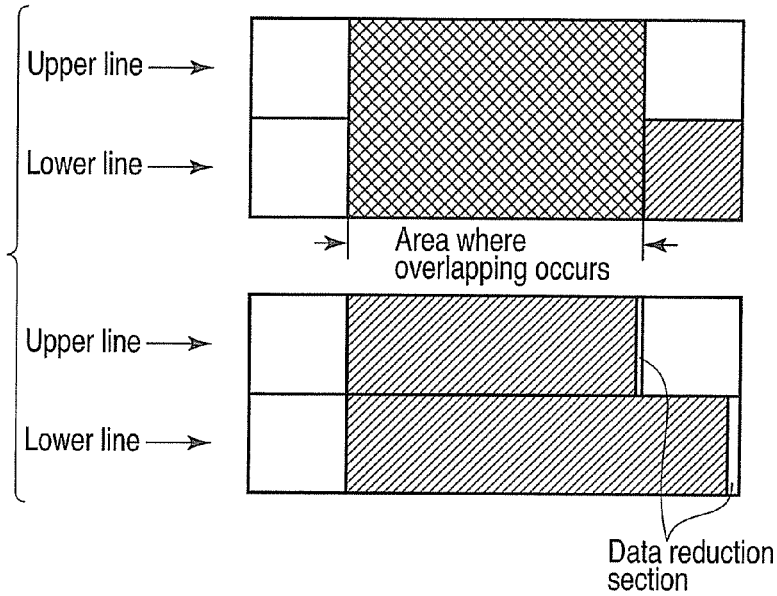
FIG. 11 is a diagram of an example of reduction of a data amount performed when the upper-and-lower-lines continuous overlapping ratio is 300%.

FIG. 11 is a diagram of an example of reduction of a data amount performed when the upper-and-lower-lines continuous overlapping ratio is 300%. The reduction ratio is 4% when the upper-and-lower-lines continuous overlapping ratio is 300%. Therefore, a data amount equivalent to 4% is reduced in both the upper line and the lower line. In the upper line, in packed three pixels, since the pixels grow from the left to the right, the right side of data is reduced by 4%. In the lower line, in the packed three pixels, since the pixels grow from the left to the right, the right side of data is reduced by 4%.

In the example explained above, the reduction of the data amount is executed on the upper line and the lower line. However, to obtain an effect of reducing density, the data amount may be reduced concerning only the upper line or the lower line. A section where the data amount is reduced may be any one of the right side, the left side, and both the sides.

The influence of a reciprocity failure is explained below.

The data amount reduction correction may be necessary or may not always be necessary depending on a type of image data, the number of lines of halftone, an angle, and the like.

The number of lines of halftone is explained below. Images with the number of lines changed to 170, 212, and 242 were generated by using the four-channel laser array. Among the generated images, density unevenness is extremely conspicuous only in the image having 212 lines. Density unevenness is not conspicuous in the image having 170 lines and the image having 242 lines.

The number of lines 170 is equivalent to a screen period of 5 and a screen angle of 45 degrees at 1200 dpi. The number of lines 212 is equivalent to a screen period of 4 and a screen angle of 45 degrees in 1200 dpi.

In the halftone of 170 lines, plural kinds of patterns of pixels affected by a reciprocity failure that occurs in a four-line period are present and uniformly disperse in an entire area. As a result, density unevenness is not conspicuous.

In the halftone of 212 lines, pixels affected by a reciprocity failure that occurs in the four-line period are regularly arranged. As a result, density unevenness tends to occur.

The following is derived from the above.

a) When the four-channel laser array is used, correction is not always necessary in screens having screen periods other than a multiple of 4 because a reciprocity failure is not conspicuous compared with a screen having a screen period of a multiple of 4.

b) However, in the screen having the screen period of a multiple of 4, correction is necessary because density unevenness is conspicuous. A state of density unevenness is different in each of halftone images. Therefore, it can be understood that the correction method by data amount reduction explained above is effective.

Correction is necessary for the image having 212 lines because the image having 212 lines corresponds to the case b). The number of lines 212 is an extremely important number of lines in a present standard MFP. Correction is not always necessary for, for example, the image having 170 lines or 242 lines equivalent to the number of lines in a). It is evident from the examination content explained above that, even if correction is performed, the correction is effective for a reduction of the influence of a reciprocity failure.

A configuration of an apparatus for realizing the data amount reduction correction explained above and the operation of the apparatus are explained below.

Figure 12:
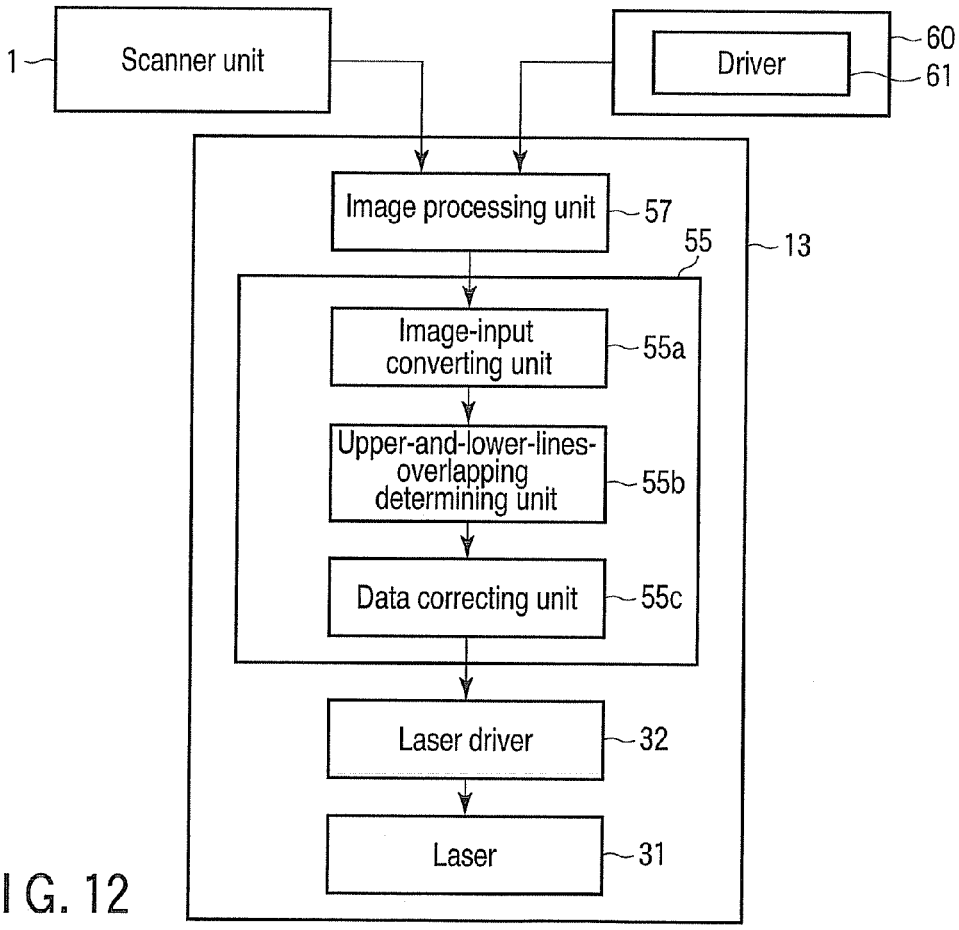
FIG. 12 is a block diagram of a schematic configuration of a control system that controls an optical system unit of the digital multi function peripheral.

FIG. 12 is a block diagram of a schematic configuration of a control system that controls the optical system unit 13 of the digital multi function peripheral.

The optical system unit 13 includes an image processing unit 57, a laser control unit 55, the laser driver 32, and the laser 31. The laser control unit 55 includes an image-input converting unit 55*a*, an upper-and-lower-lines-overlapping determining unit 55*b*, and a data correcting unit 55*c*.

Image data is input to the optical system unit 13 from the scanner unit 1. Image data is also input to the optical system unit 13 from a computer terminal (PC) 60 as an external apparatus.

In the case of copying operation, the scanner unit 1 reads an image of an original document O set on the document table 7 and sends the image to the image processing unit 57 as image data. The image processing unit 57 applies processing such as well-known shading correction, various kinds of filtering correction, gradation processing, and γ correction to the image data and sends the image data having a digital amount after the processing to the laser control unit 55.

In the case of print operation, a driver 61 of the PC 60 transfers PDL (Page Description Language) data or raster data indicating the structure of image data. The image processing unit 57 expands the PDL data in a bitmap and executes the respective kinds of image processing explained above. Thereafter, the image processing unit 57 sends the image data having a digital amount after the processing to the laser control unit 55.

The operation of the laser control unit 55 is explained below.

Figure 13:
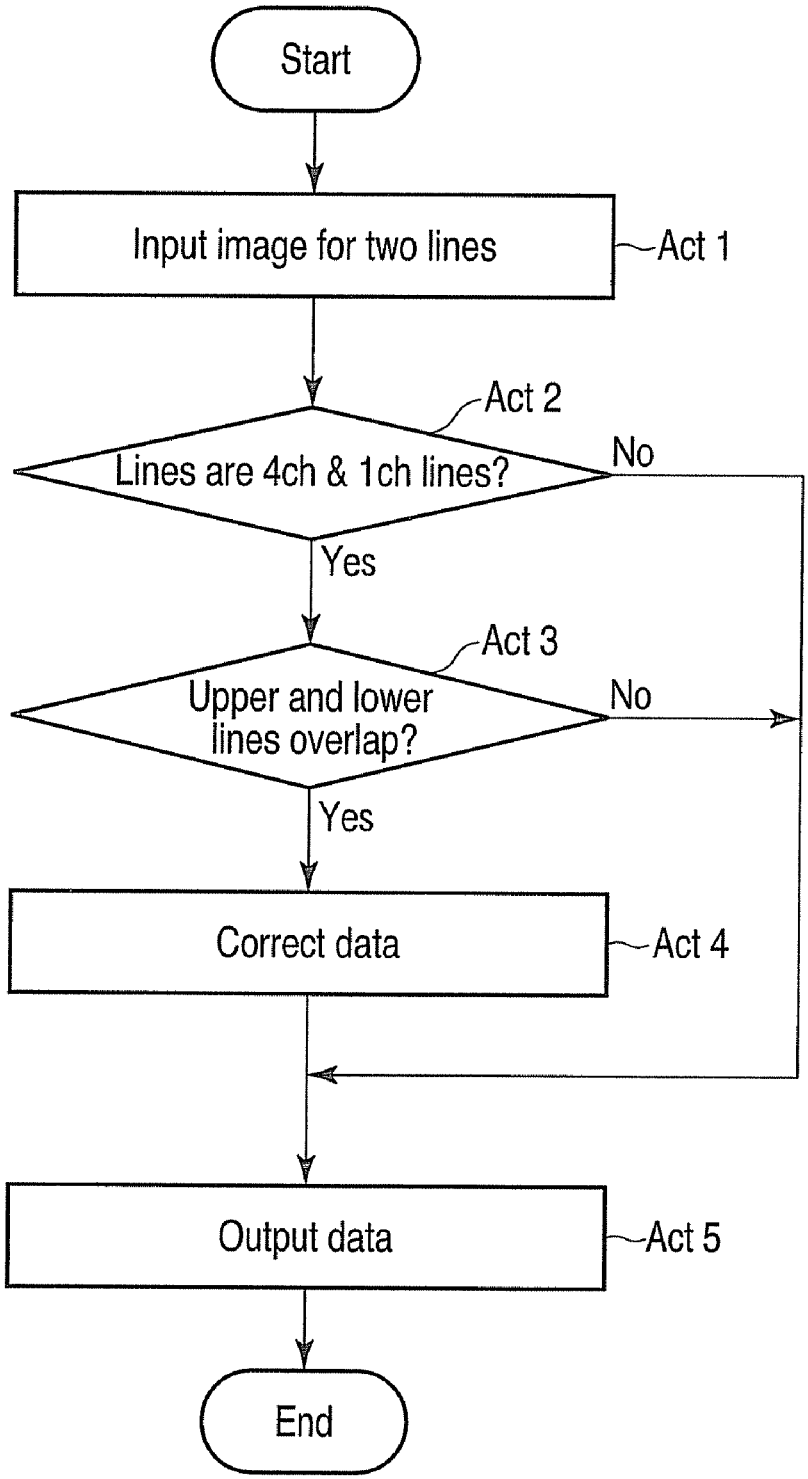
FIG. 13 is a flowchart of a schematic processing procedure of a laser control unit.

FIG. 13 is a flowchart of a schematic processing procedure of the laser control unit 55.

In Act 1, the image-input converting unit 55*a* executes the positioning control of PWM on input image data. The image-input converting unit 55*a* extracts image data for two lines out of the image data after the positioning. In Act 2, the image-input converting unit 55*a* determines whether the extracted image data for two lines is two lines in which a reciprocity failure occurs. Specifically, the image-input converting unit 55*a* determines whether the fourth channel and the first channel of the array laser scan the image data for two lines and form an electrostatic latent image across a scanning line.

If it is determined in Act 2 that the two lines are lines in which a reciprocity failure occurs (Yes in Act 2), in Act 3, the upper-and-lower-lines-overlapping determining unit 55*b* determines whether overlapping occurs in the upper and lower lines.

If it is determined in Act 3 that overlapping occurs in the upper and lower lines (Yes in Act 3), the upper-and-lower-lines-overlapping determining unit 55*b* detects a recording pattern (width) in the main scanning direction between plural pixels adjacent to each other in the sub-scanning direction and sends information concerning the recording patterns to the data correcting unit 55*c*.

In Act 4, the data correcting unit 55*c* converts the image data according to the recording pattern (width) detected by the upper-and-lower-lines-overlapping determining unit 55*b*.

As explained above, the conversion is executed by correcting a value of pulse width modulation for one pixel or plural pixels. For example, when pulse width modulation in 255 stages is corrected, 3% of 255 is reduced to convert a pulse width modulation value into 248. When pulse width extends over plural pixels, the pulse width is adjusted at an end of the pulse width.

In Act 5, the data correcting unit 55*c* outputs the corrected image data to the laser driver 32. If it is determined in Act 2 that the two lines are not lines in which a reciprocity failure occurs (No in Act 2) and if it is determined in Act 3 that overlapping does not occur in the upper and lower lines (No in Act 3), the data correcting unit 55*c* outputs the image data to the laser driver 32 without correcting the image data.

The laser driver 32 controls the laser 31 according to the image data to execute printing.

In the control method explained above, the operation of the laser control unit 55 is different from the operation in the past. However, the operations of the other units are the same as the operations in the past. Therefore, it is possible to reduce density unevenness due to a reciprocity failure without changing the scanning system in the past.

In the explanation of the embodiment, the density unevenness due to the reciprocity failure occurs in a wide area (a large area) of the image. However, when the density unevenness occurs in a narrow area (a local area) of the image, the density unevenness more conspicuously appears visually. For example, when the registration correction by digital data is carried out, the density unevenness more conspicuously appears visually.

Figure 14:
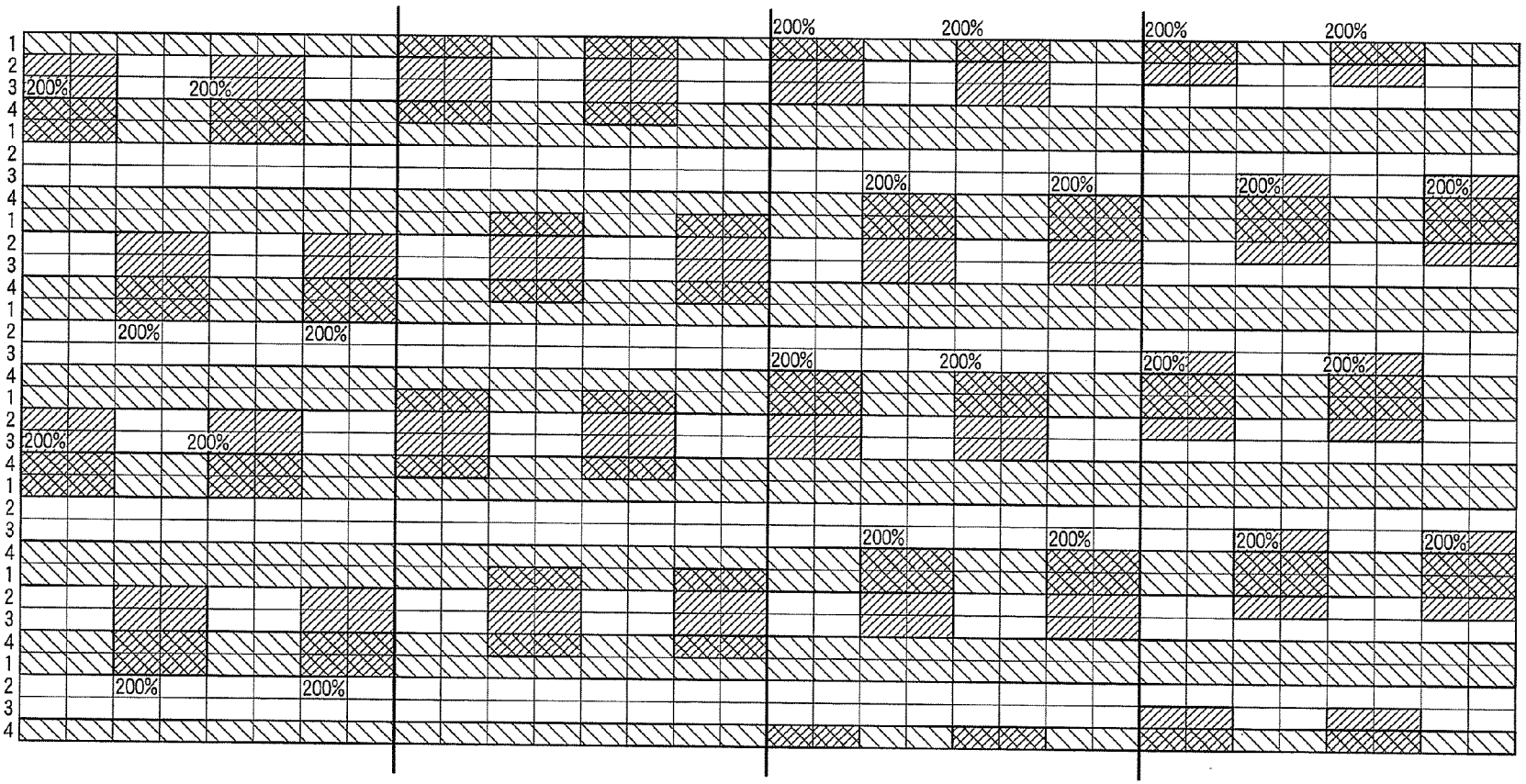
FIG. 14 is a diagram of an image subjected to registration correction by digital data.

FIG. 14 is a diagram of an image after the registration correction by digital data. In the registration correction by digital data, an image forming line is switched in one page. The density unevenness due to the reciprocity failure locally occurs in a section where the image forming line is switched. This causes image quality deterioration.

In this embodiment, both the density unevenness in the large area and the local density unevenness can be reduced. Visually, an effect of the correction for the local density unevenness is more conspicuous.

In this embodiment, the four-channel laser array is used. However, an n-channel laser array may be used to perform the same processing. Specifically, since a reciprocity failure occurs because of shift of scanning timing for laser beams in an nth channel and a first channel, the correction method according to this embodiment only has to be used for the nth channel and the first channel.

Additional advantages and modifications will readily occur to those skilled in the art. Therefore, the invention in its broader aspects is not limited to the specific details and representative embodiment shown and described herein. Accordingly, various modifications may be made without departing from the spirit or scope of the general inventive concept as defined by the appended claims and their equivalents.

What is claimed is:

1. An image forming apparatus comprising:

a laser array in which n (a natural number equal to or larger than 2) light emitting sources are arrayed;

a polygon mirror configured to reflect n laser beams emitted from the laser array and periodically scan a rotating photoconductive member to form an image on the photoconductive member;

an image-input converting unit configured to create, for each of channels of the laser array, a recording pattern for executing pulse width control from input image data and extract recording patterns of an nth channel and a first channel of the next scanning of the laser array;

an overlapping control unit configured to calculate the width of laser pulses in the same position in a main scanning direction as overlapping width from the extracted two recording patterns;

a data correcting unit configured to reduce laser pulse width in at least one recording pattern of the recording patterns of the nth channel and the first channel of the next scanning by a reduction amount corresponding to the calculated overlapping width and correct the laser pulse width; and a laser driver configured to control the intensity of laser beams in the respective channels of the laser array according to the recording patterns after the correction.

2. The apparatus according to claim 1, wherein the data correcting unit corrects the reduction amount to be smaller as the overlapping width increases.

3. The apparatus according to claim 2, wherein the data correcting unit corrects the pulse width by reducing one end of a laser pulse in the recording pattern.

4. The apparatus according to claim 2, wherein the data correcting unit corrects the pulse width by reducing both ends of a laser pulse in the recording pattern.

5. The apparatus according to claim 2, wherein the data correcting unit corrects the reduction amount to 0 when the overlapping width is 0.

6. The apparatus according to claim 1, wherein the overlapping width corresponds to width in a main scanning direction of an area where two laser spots overlap each other on the photoconductive member.

7. The apparatus according to claim 1, wherein a space between adjacent main scanning lines on the photoconductive member is smaller than a diameter of a laser spot for scanning the photoconductive member.

8. An image forming method for an image forming apparatus that reflects, via a polygon mirror, n (a natural number equal to or larger than 2) laser beams emitted from a laser array in which n light emitting sources are arrayed and periodically scans a rotating photoconductive member to form an image, the method comprising:

creating, with an image-input converting unit, for each of channels of the laser array, a recording pattern for executing pulse width control from input image data and extracting recording patterns of an nth channel and a first channel of the next scanning of the laser array;

calculating, with an overlapping control unit, the width of laser pulses in the same position in a main scanning direction as overlapping width from the extracted two recording patterns;

reducing, with a data correcting unit, laser pulse width in at least one recording pattern of the recording patterns of the nth channel and the first channel of the next scanning by a reduction amount corresponding to the calculated overlapping width and correcting the laser pulse width; and controlling, with a laser driver, the intensity of laser beams in the respective channels of the laser array according to the recording patterns after the correction.

9. The method according to claim 8, wherein the data correcting unit corrects the reduction amount to be smaller as the overlapping width increases.

10. The method according to claim 9, wherein the data correcting unit corrects the pulse width by reducing one end of a laser pulse in the recording pattern.

11. The method according to claim 9, wherein the data correcting unit corrects the pulse width by reducing both ends of a laser pulse in the recording pattern.

12. The method according to claim 9, wherein the data correcting unit corrects the reduction amount to 0 when the overlapping width is 0.

13. The method according to claim 8, wherein the overlapping width corresponds to width in a main scanning direction of an area where two laser spots overlap each other on the photoconductive member.

14. The method according to claim 8, wherein a space between adjacent main scanning lines on the photoconductive member is smaller than a diameter of a laser spot for scanning the photoconductive member.

15. An image processing apparatus that processes image data converted from a read document image and outputs the image data to an image forming apparatus that reflects, via a polygon mirror, n (a natural number equal to or larger than 2) laser beams emitted from a laser array in which n light emitting sources are arrayed and periodically scans a rotating photoconductive member to form an image, the image processing apparatus comprising:

an image input unit configured to read a document image and convert the document image into image data;

an image processing unit configured to subject the image data after the conversion to image processing;

an image-input converting unit configured to create, for each of channels of the laser array, a recording pattern for executing pulse width control from the image data subjected to image processing and extract recording patterns of an nth channel and a first channel of the next scanning of the laser array;

an overlapping control unit configured to calculate the width of laser pulses in the same position in a main scanning direction as overlapping width from the extracted two recording patterns;

a data correcting unit configured to reduce laser pulse width in at least one recording pattern of the recording patterns of the nth channel and the first channel of the next scanning by a reduction amount corresponding to the calculated overlapping width and correct the laser pulse width; and a laser driver configured to control the intensity of laser beams in the respective channels of the laser array according to the recording patterns after the correction.

16. The apparatus according to claim 15, wherein the data correcting unit corrects the reduction amount to be smaller as the overlapping width increases.

17. The apparatus according to claim 15, wherein the data correcting unit corrects the pulse width by reducing one end of a laser pulse in the recording pattern.

18. The apparatus according to claim 16, wherein the data correcting unit corrects the reduction amount to 0 when the overlapping width is 0.

19. The apparatus according to claim 15, wherein the overlapping width corresponds to width in a main scanning direction of an area where two laser spots overlap each other on the photoconductive member.

20. The apparatus according to claim 15, wherein a space between adjacent main scanning lines on the photoconductive member is smaller than a diameter of a laser spot for scanning the photoconductive member.

* * * * *